United States Patent [19]

Hynes et al.

[11] Patent Number: 4,826,216

[45] Date of Patent: May 2, 1989

[54] WELL HOUSING AND LANDING SHOULDER

[75] Inventors: Joseph H. Hynes; James H. Owens, III; William M. Taylor, all of Houston, Tex.

[73] Assignee: Cameron Iron Works USA, Inc., Houston, Tex.

[21] Appl. No.: 187,383

[22] Filed: Apr. 28, 1988

[51] Int. Cl.[4] ..... E21B 17/00; E21B 33/04; F16L 7/00

[52] U.S. Cl. ..... 285/140; 166/208; 166/88; 285/141

[58] Field of Search ..... 166/208, 207, 206, 382, 166/88; 285/140, 141, 143, 137.2, 133.2, 144

[56] References Cited

U.S. PATENT DOCUMENTS

| | | | |
|---|---|---|---|
| 3,438,653 | 4/1969 | Fowler | 285/141 X |
| 3,902,743 | 9/1975 | Martin | 166/208 X |
| 4,465,133 | 8/1984 | Bridges | 166/208 |
| 4,528,738 | 7/1985 | Galle, Jr. | 29/416 |
| 4,577,686 | 3/1986 | Milberger et al. | 166/208 |
| 4,595,063 | 6/1986 | Jennings et al. | 166/382 |
| 4,615,544 | 10/1986 | Baugh | 285/18 |

*Primary Examiner*—Stephen J. Novosad
*Attorney, Agent, or Firm*—Vinson & Elkins

[57] ABSTRACT

An improved well structure such as a well housing on which a casing hanger is to be landed which housing includes a high strength landing shoulder insert which allows the housing to support the casing hanger, its casing and the heavy loads associated therewith and with substantial pressure loads experienced in new wells. In one form of the invention an insert is provided in an internal recess in the housing and held therein by a housing ring threaded on the interior of the housing body. In another form an insert is introduced into an internal housing recess in the form of seat segments and bypass segments which are secured in place by the radial forming of a high strength seat ring. In still another form of the invention the high strength seat insert is segmented, positioned as segments in the internal housing recess and secured therein by the radial forming of a metal ring outwardly into internal recesses in each of the high strength seat insert segments. A casing hanger having a high strength landing ring carried thereon is landed on the high strength seat insert.

7 Claims, 4 Drawing Sheets

WELL HOUSING AND LANDING SHOULDER

BACKGROUND

With the increasing depth of wells and the number of casing strings used therein, one of the main concerns with the well housings and other well structures on which hangers and other equipment are landed and supported is the tremendous loading of the landing shoulders and the increasing desire to decrease the load area of these shoulders to avoid as much blockage of the interior of the housing as possible. Another factor in these housings on which casings are supported is that a flow passage is needed to allow circulation and cementing after the hanger has been landed thereon and before the annulus seal is set.

U.S. Pat. No. 4,528,738 discloses one hanger structure which is intended to support extremely heavy loads by utilizing an upper and a lower landing ring which coact with each other and with grooves in the wall of the housing against which they are set to distribute the load being supported over a greater area and thus reduces the individual stress in the housing support structure.

U.S. Pat. No. 4,595,063 provides the support of a plurality of concentric casing strings directly and totally and independently of all other strings and hangers by a plurality of load ring slips that are components of a packoff assembly.

U.S. Pat. No. 4,615,544 discloses a subsea wellhead system including a breech block connection in which the bearing area of the breech block teeth is greater than the bearing area of the housing seat for the casing hanger.

SUMMARY

The present invention provides an improved well landing seat which will support extremely heavy casing loads but has only a relatively small surface. The improved structure includes the housing, a high strength landing seat ring, and means supporting said landing seat ring in said housing for supporting hangers within the housing. In one form of the invention the high strength landing seat ring is retained and supported between the housing and a housing ring which are in threaded engagement with each other and secure said landing seat ring in its desired position. In another form of the invention, the landing seat ring which is of a high strength material is formed radially outward within insert segments which are supported in an internal cavity within the housing and the forming of the seat ring secures the seat ring and the insert segments securely within said internal cavity. In another form of the invention the landing seat ring which is of a high strength material is segmented and positioned within an annular cavity within the housing and a ring is pressure formed radially outward within the landing seat ring to secure the landing seat ring within the annular cavity.

An object of the present invention is to provide an improved housing with a high strength landing seat ring which will withstand extremely high loading but which is not correspondingly expensive nor complicated.

Another object of the present invention is to provide an improved housing with a high strength landing seat ring which will support extremely high loads and provides a bypass means for circulation which does not weaken the hanger.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
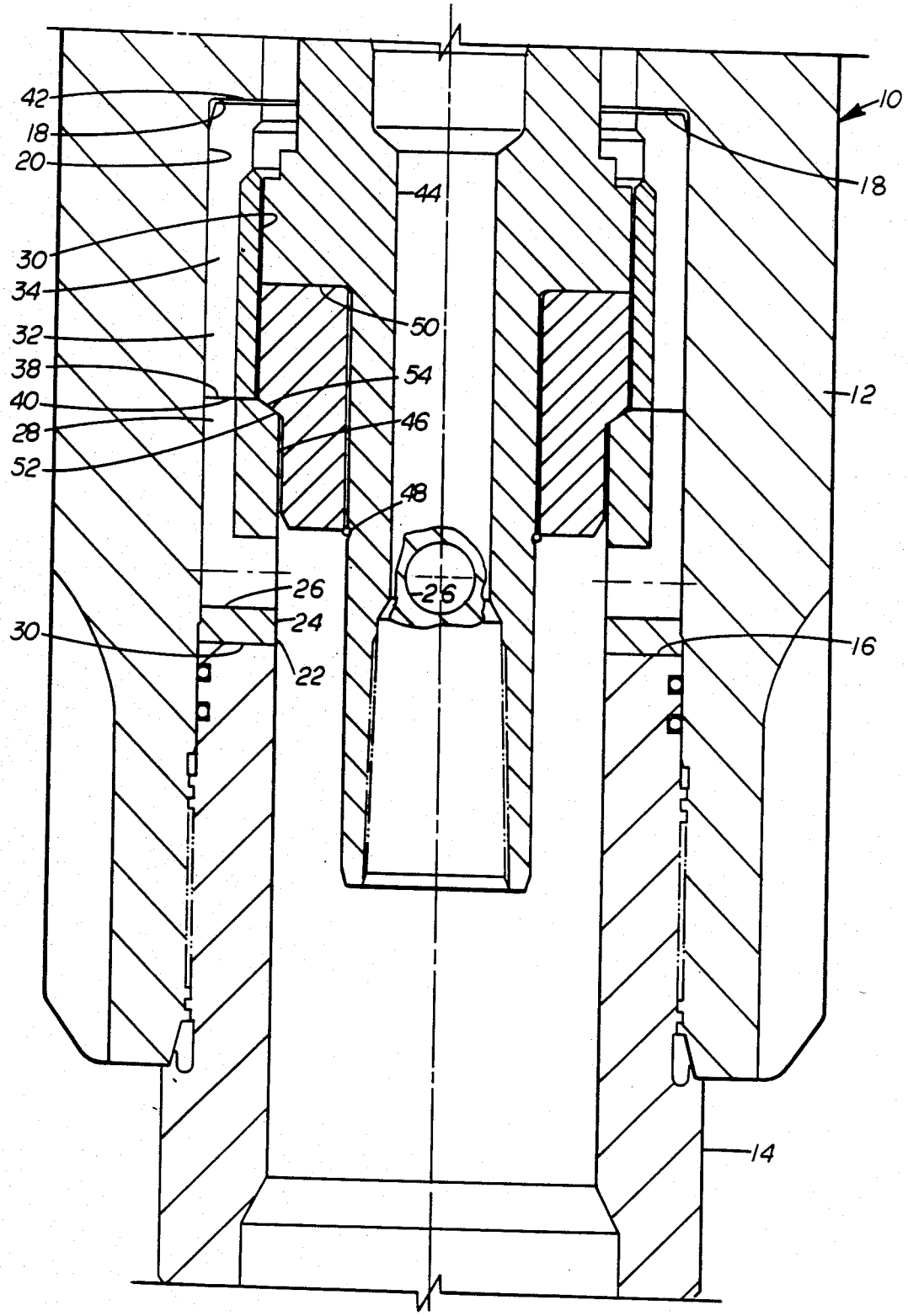
FIG. 1 is a sectional view through one form of the invention and showing a hanger supported on the high strength landing seat ring.

Well structure 10 illustrated in FIG. 1 includes well housing body 12, housing ring 14 which is threaded into the portion of body 12 at a position such that its upper end 16 is spaced a sufficient distance below downwardly facing shoulder 18 on the interior of body 12 to provide internal annular recess 20 in which seat insert ring 22 is positioned. The threaded connection between body 12 and housing ring 14 provides the means by which the seat insert ring 22 may be installed and retained within the internal annular recess 20. When seat insert ring 22 is positioned within body 12 and against downwardly facing shoulder 16, housing ring 14 is threaded therein and tightened to securely engage seat insert ring 22 in its desired position within internal annular recess 20.

Seat insert ring 22 includes high strength ring 24 which includes ports 26 extending radially therethrough and communicating with axially extending external slots 28 and flow bypass ring 30 which is positioned above ring 22 and coacts therewith. Flow bypass ring 30 includes annular outer recess 32 and axially extending slots 34. High strength ring 24 includes lower surface 36 which engages the upper end 16 of housing ring 14 and upper surface 38 which engages lower surface 40 of flow bypass ring 30. Flow bypass ring 30 also includes upper surface 42 which is slightly spaced apart from downwardly facing shoulder 18 of housing body 12.

Hanger 44 is shown positioned within housing body 12 and has its high strength landing shoulder ring 46 which is secured to its exterior by ring 48 below downwardly facing hanger shoulder 50 landed with its tapered landing surface 52 engaging tapered landing surface 54 of high strength insert landing ring 24. It is preferred that landing ring 24 and landing shoulder ring 46 be made from a suitable alloy to have a yield strength of approximately 130,000 psi and that flow bypass ring 30 have a yield strength of approximately 60,000 psi. Well housing body 12, housing ring 14 and hanger 44 are preferred to be of a suitable material to have a yield strength of approximately 85,000 psi.

Figure 2:
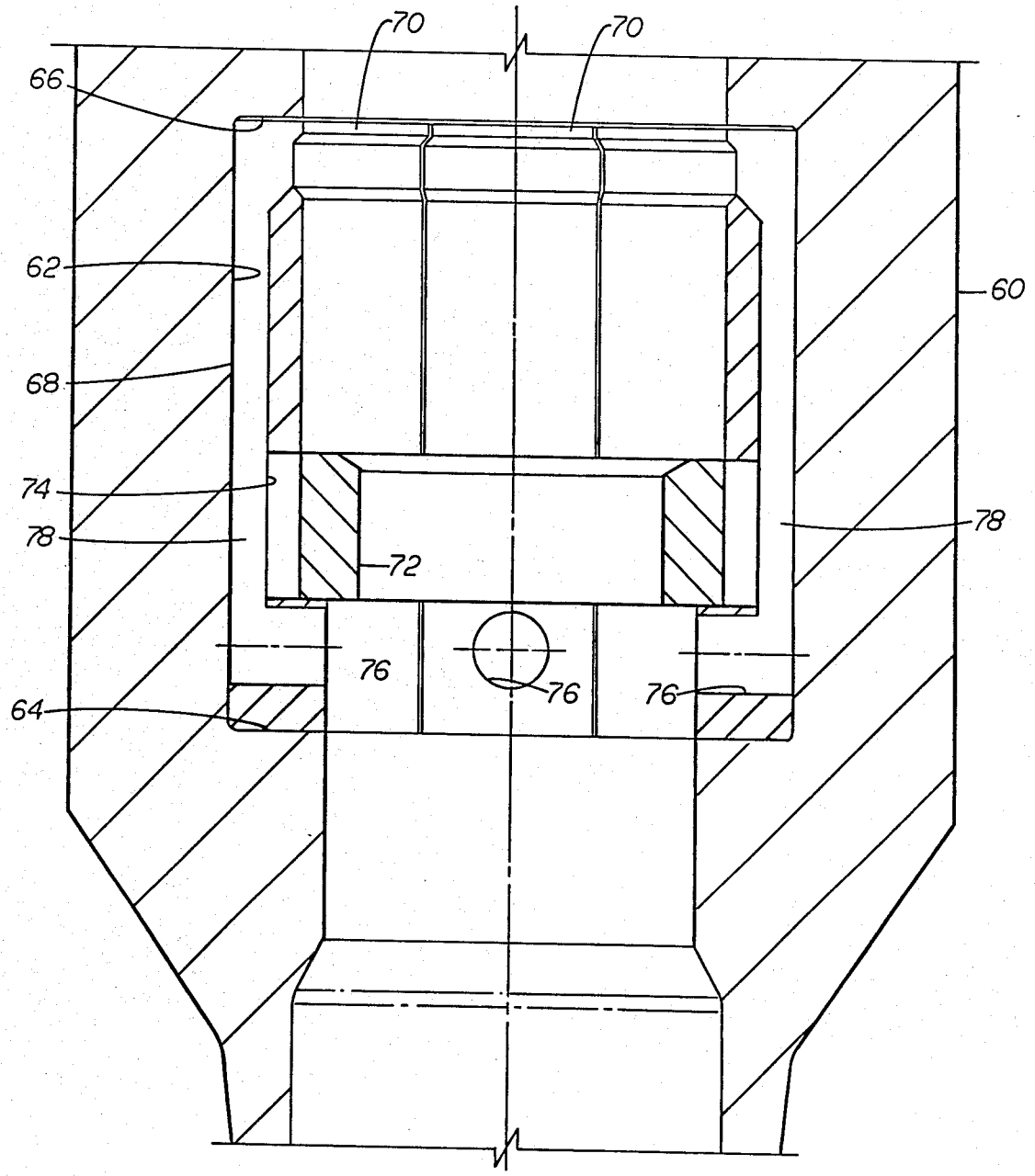
FIG. 2 is a sectional view through another form of the invention illustrating the structure ready for permanent installation in the housing recess.
Figure 3:
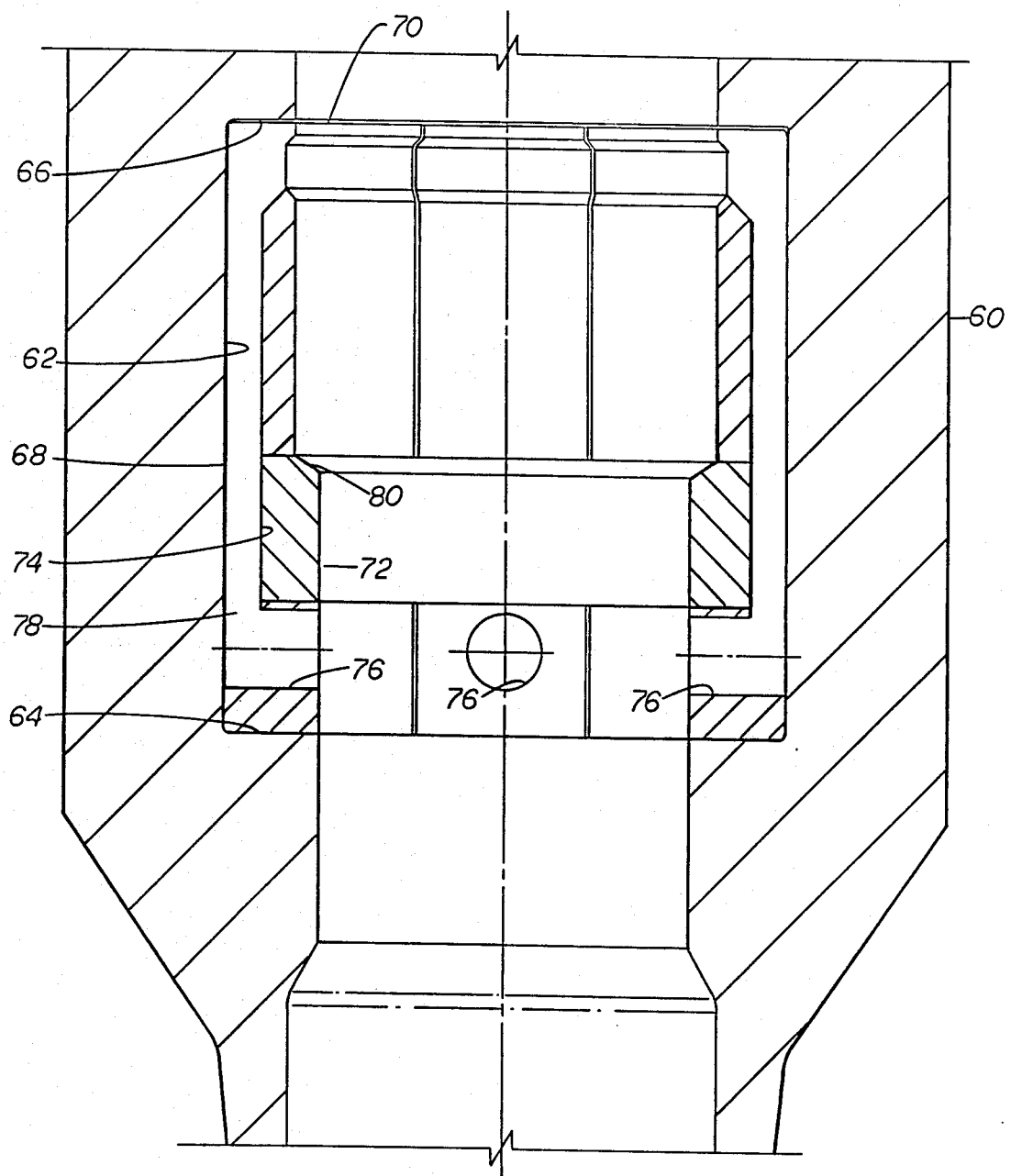
FIG. 3 is a sectional view of the structure shown in FIG. 2 after it has been formed into secure engagement within the housing recess.

The modified form of the invention shown in FIGS. 2 and 3 includes well housing 60 which includes internal annular recess 62 having lower upwardly facing shoulder 64 and upper downwardly facing shoulder 66. Insert seat ring 68 includes insert segments 70 and high strength seat ring 72 which has its original outer diameter sufficiently small to allow it to be inserted into the interior of well housing 60 and be positioned immediately inward of recesses 74 in insert seat ring segments 70. With the components in this position, high strength seat ring 72 is formed radially outwardly into recesses 74 so that segments 70 and seat ring 72 are secured within recess 62 as shown in FIG. 3.

To provide the annulus flow bypass, ports 76 extend radially through the lower portion of segments 70 and communicate with axially extending slots 78. Slots 78 communicate with the interior of housing 60 above seat ring 72. Seat ring 72 includes tapered landing shoulder 80 on its upper inner surface.

Figure 4:
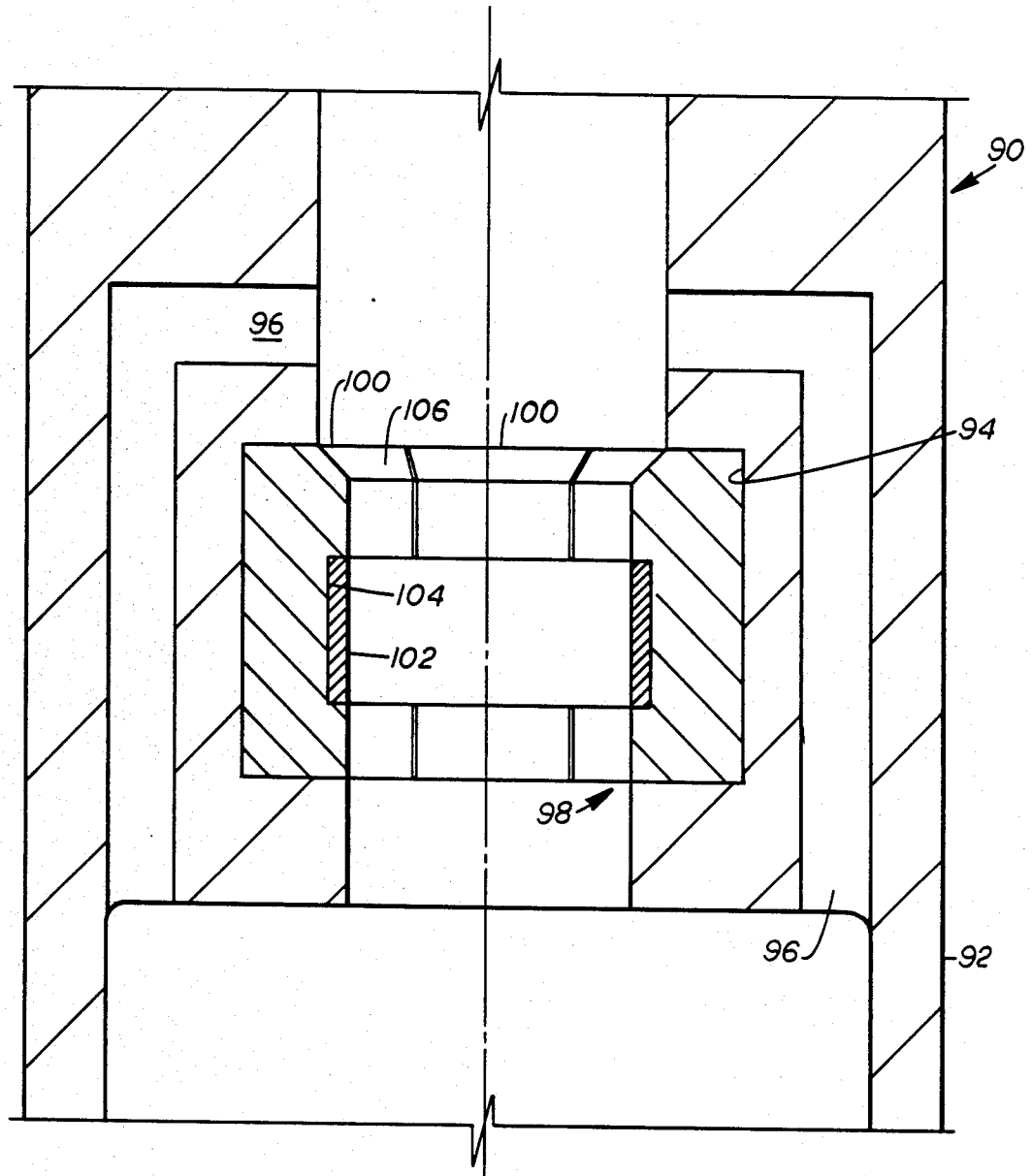
FIG. 4 is a sectional view of still another form of the invention which has been secured within the housing recess.

Well structure 90 shown in FIG. 4 includes housing 92 having internal recess 94 and flowby passages 96. High strength seat member 98 is divided into segments 100 which are positioned within recess 94 and locking ring 102 is formed into recesses 104 on the interior of segments 100 after the segments 100 have been positioned within housing recess 94. This is done by utilizing a non-high strength material for ring 102 so that it may be readily formed radially outward. High strength seat member 98 provides tapered landing shoulder 106 on which a hanger (not shown) may land.

It is preferred that the material used for the high strength landing seat insert be of a high strength steel alloy which has the desired yield strength as set forth above and care should be taken to use materials which also function in the environment of the well bore. For example, tool steel having the desired yield may be used provided that the well does not produce sulfur compounds such as hydrogen sulfide or sulfur dioxide. In such wells it is preferred that a corrosion resistant alloy be used such as a suitable Inconel alloy.

The present invention, as can be seen from the foregoing, provides a building block approach to solve the problem of the limited projected landing shoulder bearing area and spreads the shoulder load over much larger areas in the housing so that the loads are acceptable for the materials of the housing. With such building block construction, differing loads can be accommodated merely by upgrading the material of the insert. This provides a single passive load shoulder that functions every time and eliminates complicated load sharing mechanisms.

It is also an advantage of the present invention to provide the flow area in the housing for cement returns rather than in the hanger. This provides the flow area without the loss of bearing area in the landing shoulder. Also, because the housing has a greater D/t ratio than the hanger it can better handle the stresses caused by the removal of metal for the flow area. This flow area can be made larger both in total area and minimum particle size than can pass therethrough.

What is claimed is:

1. A well structure to be positioned within a well for supporting other well structure therein comprising well housing landed within the well and having an internal annular recess, a high strength landing seat ring, said high strength landing seat ring having a yield strength which is substantially greater than the yield strength of the housing, and means for securing said high strength landing seat ring within said internal annular recess of said well housing.

2. A well structure according to claim 1 wherein said securing means includes said high strength landing seat ring having been cold formed radially outward into its desired position secured within the internal annular recess of said well housing.

3. A well structure according to claim 1 including a casing hanger having a high strength landing shoulder ring supported thereon for engaging the high strength landing seat ring of said well housing, said casing hanger landing shoulder ring having a yield strength which is substantially greater than the yield strength of the well housing.

4. A well structure according to claim 1 including a plurality of segments positioned within said housing internal annular recess and having a recess for receiving said high strength landing seat ring, said high strength landing seat ring is pressure formed radially outward into tight engagement within said recess within said segments whereby said segments are secured within said housing internal annular recess.

5. A well structure according to claim 1 including a housing ring threaded to said housing and forming one end of said housing internal annular recess, said high strength landing seat ring being positioned within said housing internal annular recess with said housing ring removed and then said housing ring is threaded therein into tight securing engagement with said high strength landing seat ring.

6. A well structure according to claim 1 including a holding ring, said high strength landing seat ring being divided into segments which are positioned within said housing internal annular recess and having an annular recess for receiving said holding ring, said holding ring being formed radially outward into tight engagement with the annular recess in said seat ring segments to retrain said segments in secure engagement with said housing internal annular recess.

7. A well structure according to claim 1 wherein said high strength landing seat ring has a yield strength of approximately 130,000 psi and the well housing has a yield strength of approximately 85,000 psi.

* * * * *